US010058481B1

(12) United States Patent
Russo

(10) Patent No.: US 10,058,481 B1
(45) Date of Patent: Aug. 28, 2018

(54) SAFETY SEALED BOTTLE STOPPER

(71) Applicant: Ronald D. Russo, Naples, FL (US)

(72) Inventor: Ronald D. Russo, Naples, FL (US)

( * ) Notice: Subject to any disclaimer, the term of this patent is extended or adjusted under 35 U.S.C. 154(b) by 0 days.

(21) Appl. No.: 14/999,770

(22) Filed: Jun. 25, 2016

(51) Int. Cl.
*A61J 3/00* (2006.01)
*A61J 1/14* (2006.01)
*A61J 7/00* (2006.01)

(52) U.S. Cl.
CPC ..... *A61J 1/1406* (2013.01); *A61J 1/1481* (2015.05); *A61J 7/00* (2013.01); *A61J 2200/10* (2013.01)

(58) Field of Classification Search
CPC ..... A61J 1/1406; A61J 1/1481
See application file for complete search history.

(56) References Cited

U.S. PATENT DOCUMENTS 6,030,312 A 2/2000 Nesbitt et al.
6,361,744 B1 3/2002 Levy
6,752,965 B2 6/2004 Levy
7,128,228 B2 10/2006 Collins
7,438,552 B2 10/2008 Manera et al.
8,459,312 B2 6/2013 Manera
2008/0015539 A1* 1/2008 Pieroni ..... A61J 1/2096 604/403

* cited by examiner

*Primary Examiner* — Tatyana Zalukaeva
*Assistant Examiner* — Kai Weng
(74) *Attorney, Agent, or Firm* — Robert J Doherty

(57) ABSTRACT

A safety sealed bottle stopper in the form of a one-piece unitized fusion over-molded injection molded component comprising an exterior housing having multiple sealing fins forming an internal liquid leakproof engagement with the interior bottle neck of a liquid medication bottle container and having an upper entrance port and a lower fluid flow path with a valve positioned between the lower fluid communication path and the upper entrance port. The upper entrance port is configured to form a liquid tight engagement fit only with an oral/enteric tip syringe and not with an I.V. (intravenous) luer slip tip syringe to indicate to the user that the stopper is only to be used with an oral/enteric syringe and not an I.V. luer slip tip syringe as a safety feature which is especially useful when the stopper is used as part of an infant's or child's liquid medication bottle container.

3 Claims, 8 Drawing Sheets

31
32
30
14
16
13
12.1
16
11
10
19
25
26
27
20
28
34
33
29
14A
14B
23
22
24

10-10

SAFETY SEALED BOTTLE STOPPER

This application claims the benefit of U.S. Provisional Patent Application Ser. No. 62/231,725 filed Jul. 14, 2015.

BACKGROUND OF THE INVENTION

This invention relates to a stopper for bottles containing liquid which can be inserted into the neck opening of any type of liquid medication bottle. Bottle stoppers fall into two main types including the open style and the closed style. Open style bottle stoppers or adapter plugs for bottles containing liquid substances are typically the type manufactured and marketed by Apothecary Products, LLC, Burnsville, Minn. as Item Nos. 75125, 75126, 75127 and 75128. These open style stoppers are available in several different bottle neck opening sizes—typically 20 mm, 24 mm and 28 mm and are injection molded in one piece from low-density rigid polyethylene. These stoppers are formed with outer ridges which friction press fit against the inside of the bottle neck's opening and have a central hole which can accept an oral/enteric tipped syringe. Once the stopper adapter is inserted into the bottle neck opening, the user can insert the oral syringe tip into the central opening to withdraw the prescribed liquid oral dosage that is usually one to five milliliters utilizing the oral/enteric tipped syringe. An open style stopper adapter slows the release of fluid flowing out of the bottle but is not a child safety stopper adapter because fluid can still flow out of the bottle, and a child can still mistakenly or accidentally drink or suck from the bottle through the central stopper adapter opening. As such, the open style adapter realistically is not a safety sealed bottle stopper adapter whose key purpose is to prevent accidental child poisoning and overdosing.

In an effort to improve upon these open style stopper adapters, various prior art self-sealing bottle closures have been conceived. U.S. Pat. Nos. 6,752,965, 6,361,744, 6,030,582 and 6,030,582 all to Levy disclose various self-sealing bottle closures. Also, U.S. Pat. Nos. 8,459,312 and 7,438,552 to Manera et al. disclose press-in type bottle adapters. Lastly, U.S. Pat. No. 7,128,228 to Collins also discloses a container closure. Levy further perfected his closures into a commercial stopper marketed by Andwin Corporation, Woodland Hills, Calif. Manera et al. perfected his bottle adapter into a commercial product marketed by Comar Inc. Buena, N.J.

Both the Levy commercial device and the Manera et al. commercial device utilize a built-in check valve that is supposed to be in a normally biased closed position to prevent fluid from leaking or dripping out through the stopper adapter when the bottle is inverted and prior to opening the built-in check valve by the oral syringe tip. In actual practice, the commercial Manera et al. product has limitations because the product's complete rigid plastic construction makes it difficult to provide a non-leaking duckbill valve that also readily accepts and provides a leakproof sealable engagement with an I.V. (intravenous) luer slip tip syringe. The Levy product has been more commercially successful, but the Levy stopper's main shortcoming is that the stopper also readily accepts and provides a leakproof sealable engagement with the smaller dimensioned I.V. luer slip tip syringes. Many hospitalized or at-home child patients are often administered both oral syringe liquid medications into the mouth and I.V. syringe medications into an I.V. catheter. Except for the size differences, an I.V. luer tip syringe does not look much different from an oral/enteric syringe, and these misapplications are possible and especially likely in home application settings.

A closed system safety sealed bottle stopper that will indicate to the user that the stopper is only to be used with an oral syringe and not an I.V. luer slip tip syringe would be most useful in preventing misuse and misapplication. Misapplication refers to what happens when a medical device intended for one purpose is inadvertently used for another purpose or application. More specifically, I.V. luer slip tip syringes are intended for I.V. vascular system use and not for oral use. Likewise, oral syringes are intended for oral use only and not for I.V. use. It would be most helpful to have a closed system safety sealed bottle stopper to prevent the inadvertent syringe aspiration and administration of liquid oral medication into an infant's or child's I.V. catheter. Even a small dosage of liquid oral medication into an infant's or child's vascular system via an I.V. catheter can have catastrophic results.

Toward the prevention of such an aforementioned situation as well as others, the safety sealed bottle stopper has been conceived.

SUMMARY OF THE INVENTION

The present safety sealed bottle stopper invention takes the form of a one-piece unitized fusion over-molded injection molded component. This bottle stopper can be molded in different sizes to typically plug into and fit inside the bottle neck opening of variously sized liquid medication bottles such as 20 mm, 24 mm, and 28 mm neck bottles. All of the bottle stopper's various functional elements are integrally molded as part of the stopper to produce an inexpensive single use bottle product that can be either incorporated as part of the factory manufactured liquid medication bottle or as an aftermarket device which can be inserted into any liquid medication bottle container by the pharmacist or user.

The bottle stopper comprises a rigid exterior molded housing having multiple circular outer compression sealable fins that will press fit into the interior bottle neck's opening. Once press fitted into the bottle neck's opening, the stopper's included top flange seats the stopper on the top rim of the bottle neck's opening.

The top flange includes an upper entrance port opening with a lower diaphragm septum having a centrally perforated slit that forms a split septum valve. The exterior outer fins have the dual purpose of both forming a liquid tight, that is, leakproof outward compressive seal between the stopper and the interior liquid contents of the bottle while simultaneously producing an inward compressive force which biases the split septum valve seal to a normally closed position.

Positioned below the split septum valve is a lower fluid communication path wherein the valve is positioned between the lower fluid communication path and the upper entrance port. The split septum valve seal will permit entry of all known oral/enteric syringes that have slightly oversized dimensions when compared to the slightly undersized tip dimensions of a luer slip tip syringe. In addition, oral/enteric syringes are usually small volume syringes having capacities between 1 ml upward to 10 ml.

These oral/enteric syringes also have randomized dimensioned tip configurations that are oversized to prevent connection to rigid female I.V. luer catheters. By comparison, luer slip tip syringes have mandatory universal outside diameter tip dimensions and lengths which must meet ISO ANSI 594 1986 compliant luer slip tip syringe standards.

In operation, the split septum valve will permit entry of both oral syringes and luer slip tip syringes; however, the upper entrance port is so configured to only form a liquid tight seal between the oral/enteric tipped syringe, but conversely the upper entrance port will fail to form a liquid tight seal with a smaller dimensioned luer slip syringe tip. This is precisely the safety feature that provides a misuse and misapplication signal to the user or caregiver that the stopper is intended only for use with an oral/enteric tip syringe and not with an I.V. luer slip tip syringe. The signal indication is quite evident to the user because the user is confronted with liquid medication leaking out from the split septum valve and the entrance port when a smaller dimensioned luer slip tip syringe is used. When such intentional leakage occurs, the user is, in effect, cautioned that the device is only intended for use with an oral/enteric tip syringe, and the user thus should use the correct syringe type, that is, the larger oral/enteric tip syringe. As such, the present invention is the only known safety sealed bottle stopper which can only be used in conjunction with an oral/enteric syringe and not with an I.V. luer slip tip syringe without signaling to the user that the I.V. luer slip tip syringe is being misapplied.

Toward this end, it is the primary object of the present invention to provide a safety sealed bottle stopper that will form a liquid tight or leakproof seal with the bottle neck's opening of a wide variety of differently sized bottles to prevent medication overdose by children.

It is another object to provide a stopper that is low cost, single bottle use and disposable with the bottle after use.

It is another object to provide a stopper that will permit entry of all known oral/enteric syringes to provide accurate syringe aspiration and dosing when used in conjunction with an infant's or child's liquid medication bottle container.

It is another object to provide a stopper which is a closed system and will only dispense liquid medication by use of an accurate dosage graduate oral/enteric syringe.

Other advantages, objects, and features of the present invention stopper will become readily apparent from the following detailed description of the invention and from the accompanying drawings.

DESCRIPTION OF THE DRAWINGS

In the drawings which illustrate the best mode presently contemplated for carrying out the present invention.

DETAILED DESCRIPTION OF THE INVENTION

Figure 1:
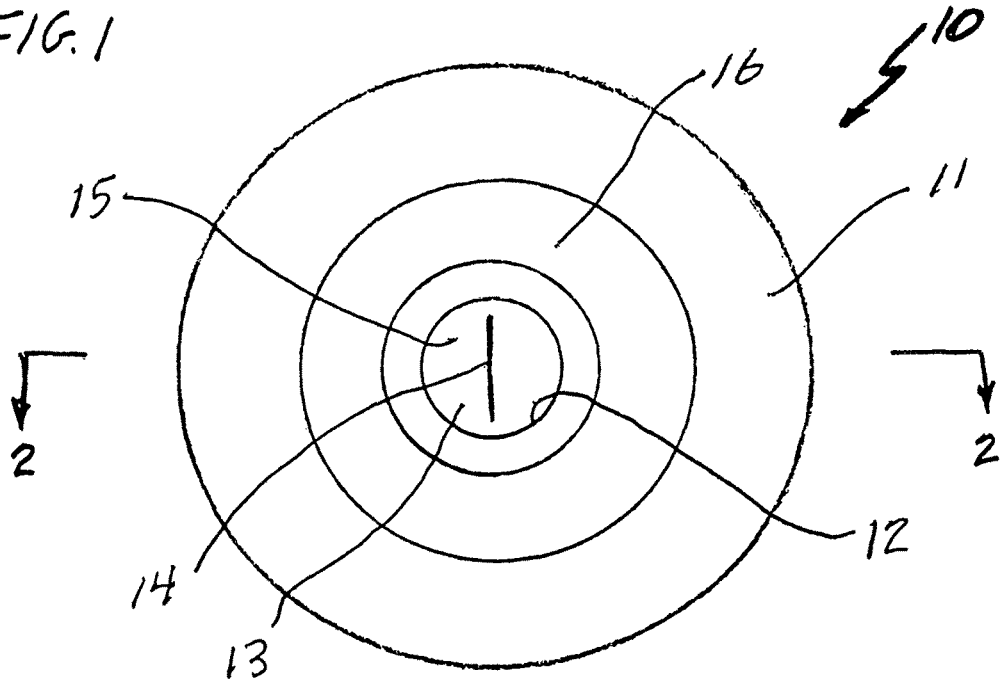
FIG. 1 is a top view of the stopper.

Turning now to the drawings and particularly to FIG. 1 thereof, FIG. 1 is a top view of safety sealed bottle stopper 10 having an exterior injection molded housing 11 molded from semi-rigid low-density polyethylene. Centrally positioned in the housing 11 is upper entrance port 12 having a circular port opening 12.1 which opening is dimensioned to be approximately 0.200 inches in internal diameter. The configuration and dimensions of the port opening 12.1 has been determined to be very important to the functionality of the stopper 10 that will be more evident from continued discussion and viewing of subsequent detailed drawings.

Positioned below the port 12 is split septum valve 13 also molded from synthetic resilient rubber of between 40 to 50 Shore A durometer. Several elastomeric thermoplastics from PolyOne GLS Corporation, McHenry, Ill. 60050 can be utilized to mold or configure the valve 13. It is important that the resilient valve 13 be molded from a thermoplastic synthetic rubber of a type to form a co-joined insert over-molded fusion bond with the semi-rigid low-density polyethylene resin used to the form housing 11. The insert over-molded fusion bond process generally either places an already formed component into a specialized injection mold after which a different molding material is injected into the mold or injects a first material into the mold and then alters the mold configuration and injects a second different material thereinto to, in effect, form a single piece or unit of two different materials—in this case, the softer synthetic rubber of portions 12, 13, 14, 15, 16 and 17 and the more rigid material forming the housing 11. The resultant stopper 10 is a one-piece component of two different or dissimilar materials.

A slit 14 is formed in the diaphragm septum portion 15 of the valve 13. The slit 14, in effect, forms two edge surfaces 14A and 14B that are in face-to-face sealing contact with each other when the valve 13 is closed. The ideal width of slit 14 has been determined to be approximately 0.180 inches wide. This 0.180 inch slit width is also very important to the functionality of the stopper device 10.

Figure 2:
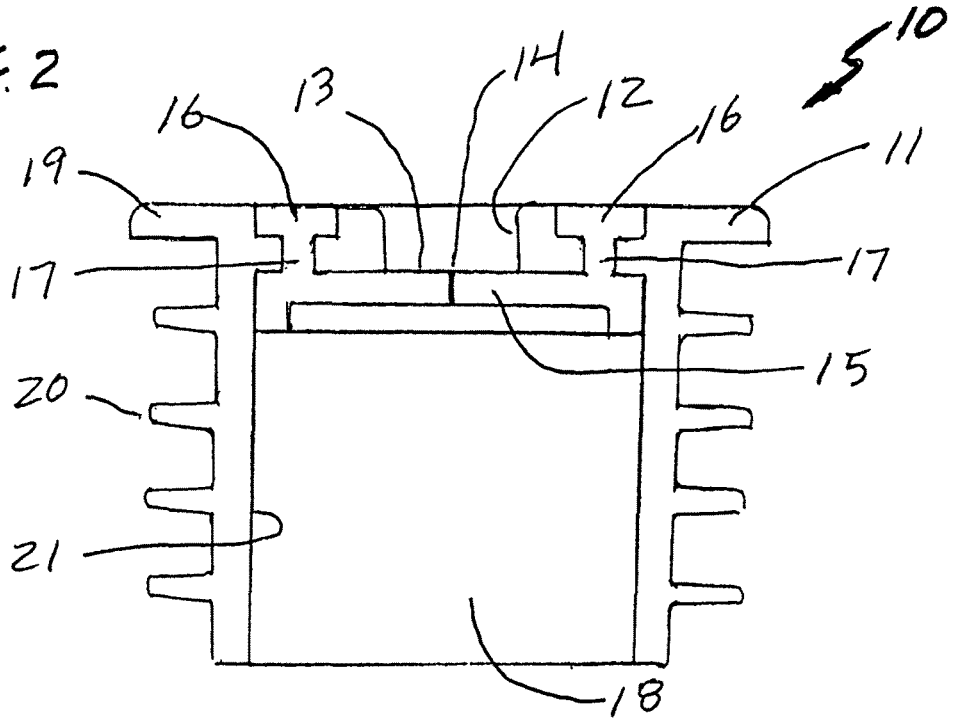
FIG. 2 is a cross-sectional view of the stopper taken along Lines 2-2 from FIG. 1.

The co-joined insert over-molding process also enables the formation of the housing top surface seal ring 16 that is produced from and part of the lower split septum valve 13 that can be more clearly seen in cross-sectional views from FIG. 2. As such, FIG. 2 is a cross-sectional view of the stopper 10 taken along the Lines 2-2 from FIG. 1. FIG. 2 clearly depicts the elements previously described in FIG. 1 and shows how the valve 13 forms a co-joinment with the housing 11 such that the resilient resin of the valve 13 flows upward through flow pins or sprues 17 to form the top surface seal ring 16. These flow pins 17 are formed in vertical passages within the mold in spaced positions around the periphery of the seal ring 16.

Figure 3:
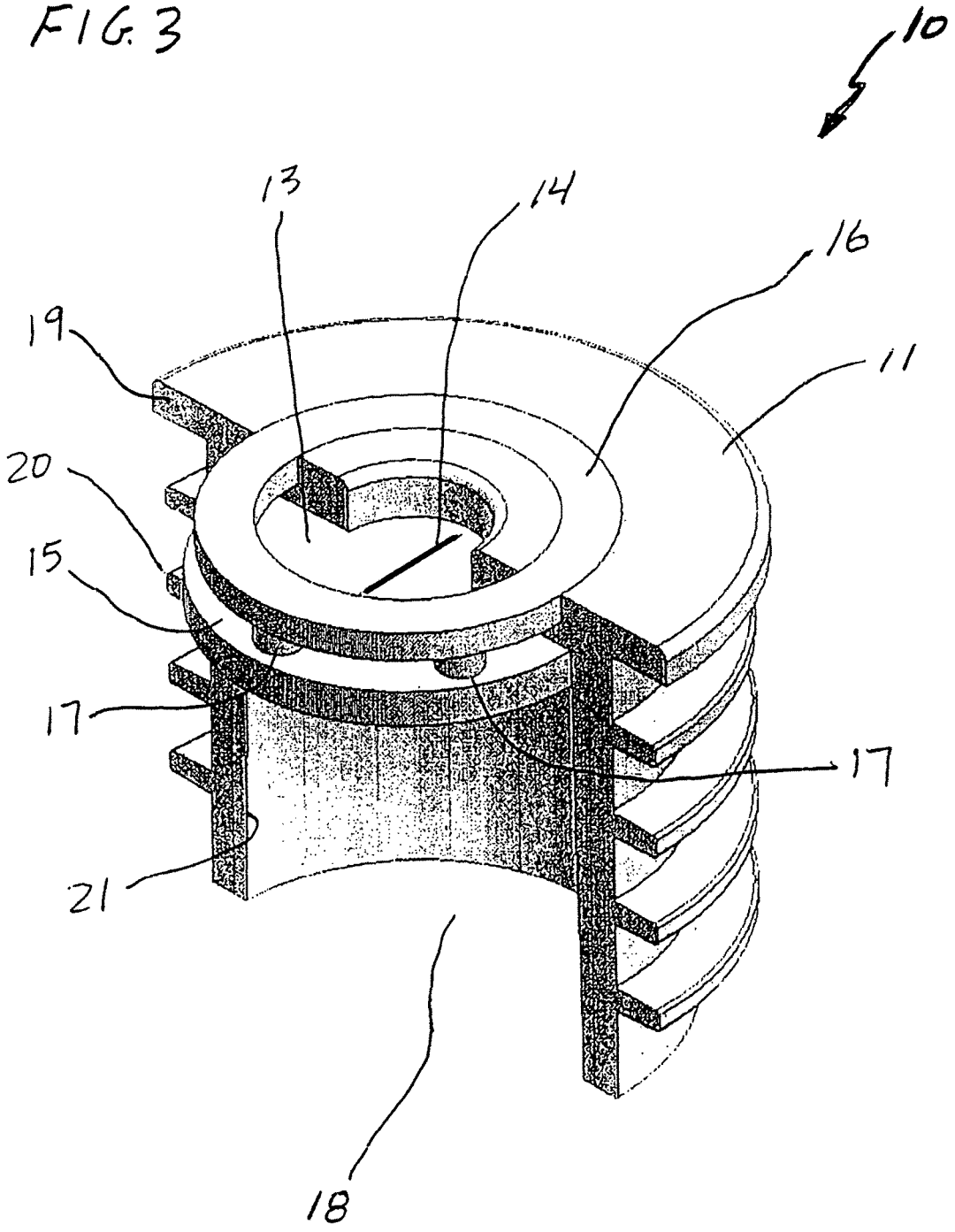
FIG. 3 is a partial cross-sectional perspective view of the stopper depicted in FIG. 2.
Figure 4:
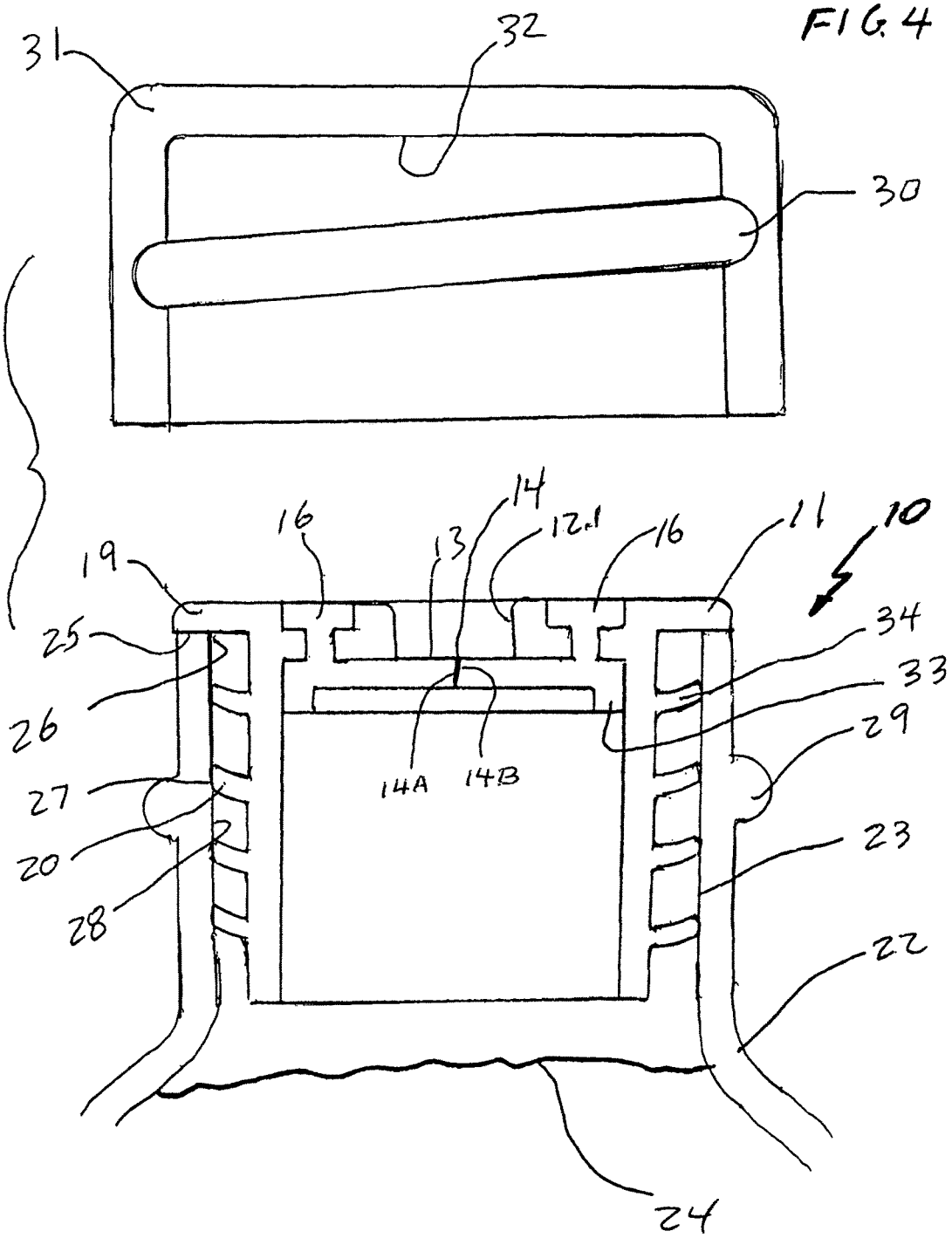
FIG. 4 is a cross-sectional view of the stopper inserted into the neck of a liquid medication bottle including the bottle closure cap.

Further, the housing 11 has a lower fluid communication path 18 wherein the valve 13 is positioned between the lower fluid communication path 18 and the upper entrance port 12. The housing 11 includes a top flange 19 of about 0.840 inches in diameter and only about 0.050 inches thick for the purpose of forming a stop fit with the top surface of a liquid filled bottle container is shown and described in subsequent drawings. Also molded-in as part of the housing 11 are four generally identical outwardly extending radial fins 20 as illustrated. The fins 20 are molded in a thickness of about 0.035 inches and constructed and configured to be both semi-rigid and somewhat flexible. The interior walls 21 of the housing 11 are also shown having a much thicker wall thickness of about 0.060 inches to give the stopper 10 substantial rigidity once inserted into a bottle's neck opening. The total height of the stopper 10 and the walls 21 is about 0.700 inches to provide a substantial internal non-removable grip fit with the container's neck opening of a popular 24 mm sized bottle. The illustration of the stopper 10's construction is further depicted by the partial cross-sectional view of FIG. 3 showing the elements in a perspective view from FIG. 2. Of special note is the illustration of the co-joined fusion bonding between the polyethylene housing 11 and the elastomeric valve 13 taking place through multiple flow pins 17 that form an internal leakproof seal between the housing 11 and the valve 13. FIG. 4 depicts the non-removable press fit of the stopper 10 within the bottle container 22 having a bottle neck opening 23.

The liquid bottle container 22 is typically plastic blow molded of semi-rigid polyethylene plastic to package liquid cough syrup or fever reducing medications 24 and the like for adults as well as infants and children. Once the stopper 10 is press fit into the opening 23, the top housing flange 19 will form a stop ledge 25 with the container bottle's internal rim 26. The semi-rigid polyethylene housing fins 20 are dimensioned to about 0.800 inches in diameter to flex at their tips 27 to form a liquid tight, that is, leakproof, internal flexible seal with the 0.750 inch inner diameter walls 28 on the bottle's neck opening 23 to effect a non-removable press fit. It should be noted that the aforementioned dimensions provided for the stopper 10 to the bottle container 27 assembly are for a 24 mm bottle which is a very popular size for a liquid medication bottle. The stopper 10 can easily be altered or configured to fit the 28 mm or 20 mm bottle sizes as well without departing from the basic structural assembly of the underlying stopper device of the present invention by plastic packaging engineers skilled in the art.

Once inserted, the stopper 10 is very difficult to remove from the bottle neck's opening 23. The bottle neck's external screw thread 29 is the defining dimension to reference the different bottle sizes of 28 mm, 24 mm or 20 mm. The external thread 29 forms a threaded cap engagement with the mating internal screw thread 30 on the screw cap 31 that is typically plastic injection molded from polyethylene or polypropylene. Often, the caps 31 are of the child safety type. Once the screw cap 31 is affixed onto the bottle container 22, the top seal ring 16 on the top of the flange 19 will form a liquid tight seal with the underside flat surface 32 of the cap 31 to provide an extra level of leakproof seal-ability of the stopper 10 with the cap 31 interface during packaging or transport. The top flange 19 on the housing 11 is about 0.050 inches in thickness that is thick enough to allow the screw cap 31 to be easily screwed onto any bottle container 22 to permit the addition of the liquid tight screw cap 31 on top of the stopper 10. This means that the stopper 10 can be assembled at the medication or pharmaceutical production facility as an integral part of the bottle container or can be a standalone aftermarket component often used by a pharmacy when preparing a patient's prescribed liquid-filled bottle prescription.

Also from FIG. 4, the split septum valve 13 has an outward circular wall 33. The slit opening 14 includes the face-to-face edge surfaces 14A, 14B thereof that are compressively biased sealed closed by the inward compressive force being applied thereto via the housing wall 21, that is, by the press fit fin 34 within the bottle neck's opening 23 that is positioned laterally adjacent the wall 33. Accordingly, the split septum diaphragm valve 13 functions as a normally biased closed valve 13 which prevents any spillage or leakage of the bottle medication fluid contents 24 out of valve 13 during transport.

The normally biased closed valve 13 is especially important when the stopper is used as a child safety sealed bottle because the valve 13 prevents oral ingestion of liquid filled medication contents from the container even if a child attempts to orally ingest the contents by squeezing the bottle to apply pressure to the valve 13 such as a baby bottle would normally be used by a small child. Thus, the stopper 10 of the present invention can be utilized with all types of infants' or children's liquid medication bottles to prevent medication overdosing and provide poison control as a closed system bottle stopper.

Figure 5:
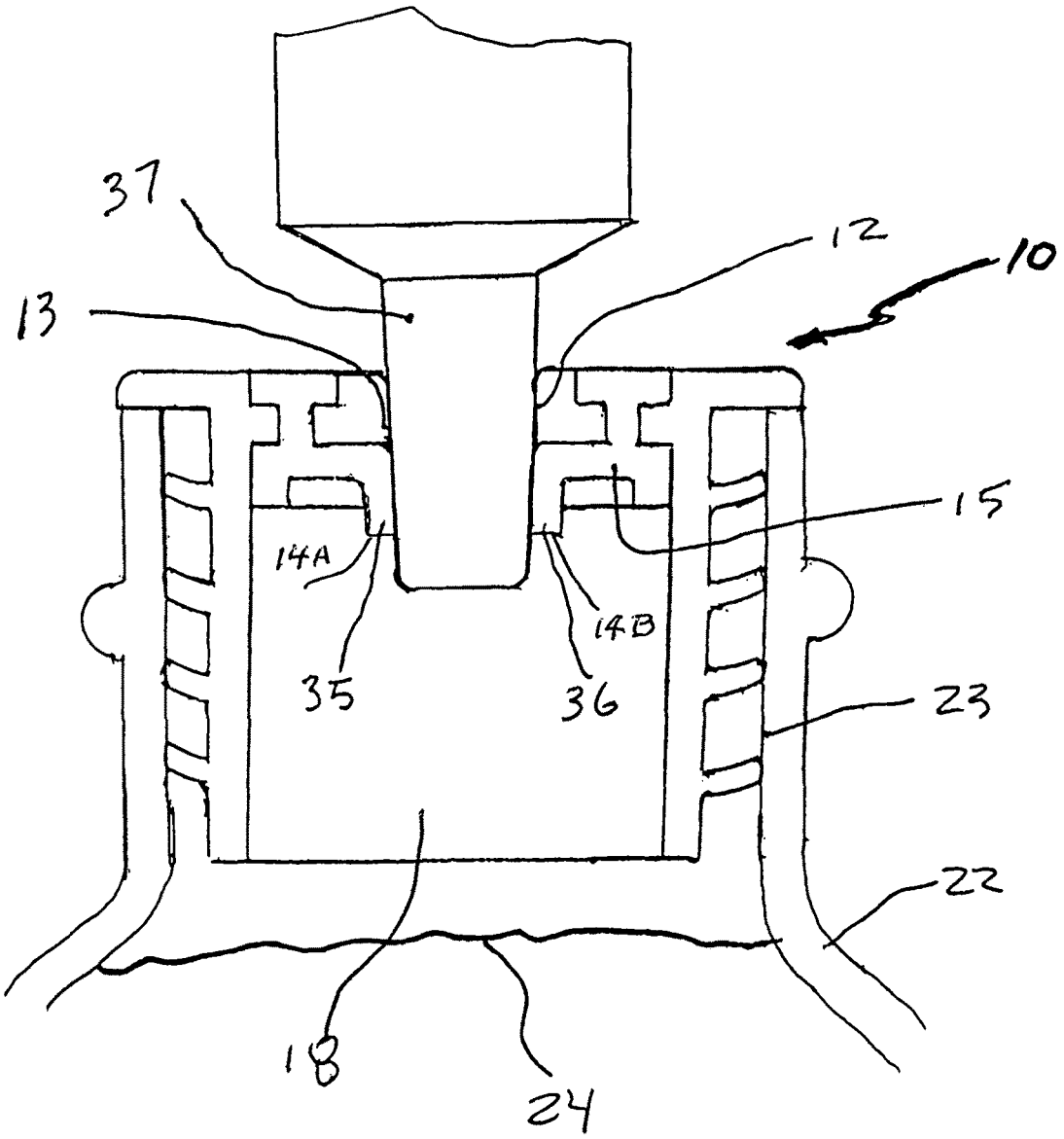
FIG. 5 is a cross-sectional view of the stopper accepting an oral enteric tip syringe.

FIG. 5 is a cross-sectional view of the stopper 10 capable of accepting and forming an engagement seal with only an oral enteric syringe tip 37. Oral/enteric syringe tips 37 have a typical randomized outside diameter of between 0.190 inches up to a slight taper of 0.230 inches in diameter. This outside diameter is larger than the standardized I.V. luer slip tip syringe tip diameter of 0.160 inches as defined and controlled by the ISO/ANSI 1986 luer standards. As such, the upper entrance port 12 having an internal diameter opening of 0.200 inches as shown and described in FIGS. 2 and 3 can only form an effective surface to surface engagement seal with the oral/enteric syringe tip 37 and not the much smaller standardized outside diameter of an I.V. luer slip tip syringe. In essence, the oral enteric syringe tip 37 opens the valve 13 to permit a spill proof liquid communication path 18 by opening the leaves 35 and 36 on the split septum valve diaphragm 15 as shown.

The unitized fusion over-molded diaphragm 15 along with the diaphragm's internal leafs 35 and 36 are flexibly molded from synthetic rubber and are approximately 0.050 inches thick. This 0.050 thickness has been found to be ideal to provide a liquid tight sealable fit between the leafs 35 and 36 and the oral syringe tip 37. While 0.050 inches is an ideal thickness for the diaphragm 15 and thus the leafs 35 and 36, thicknesses between 0.035 inches upward to 0.080 inches will also produce a liquid tight sealable fit between the diaphragm 15, leafs 35 and 36 and an oral syringe tip 37 when using a slit width of 0.180 inches as previously described.

Figure 6:
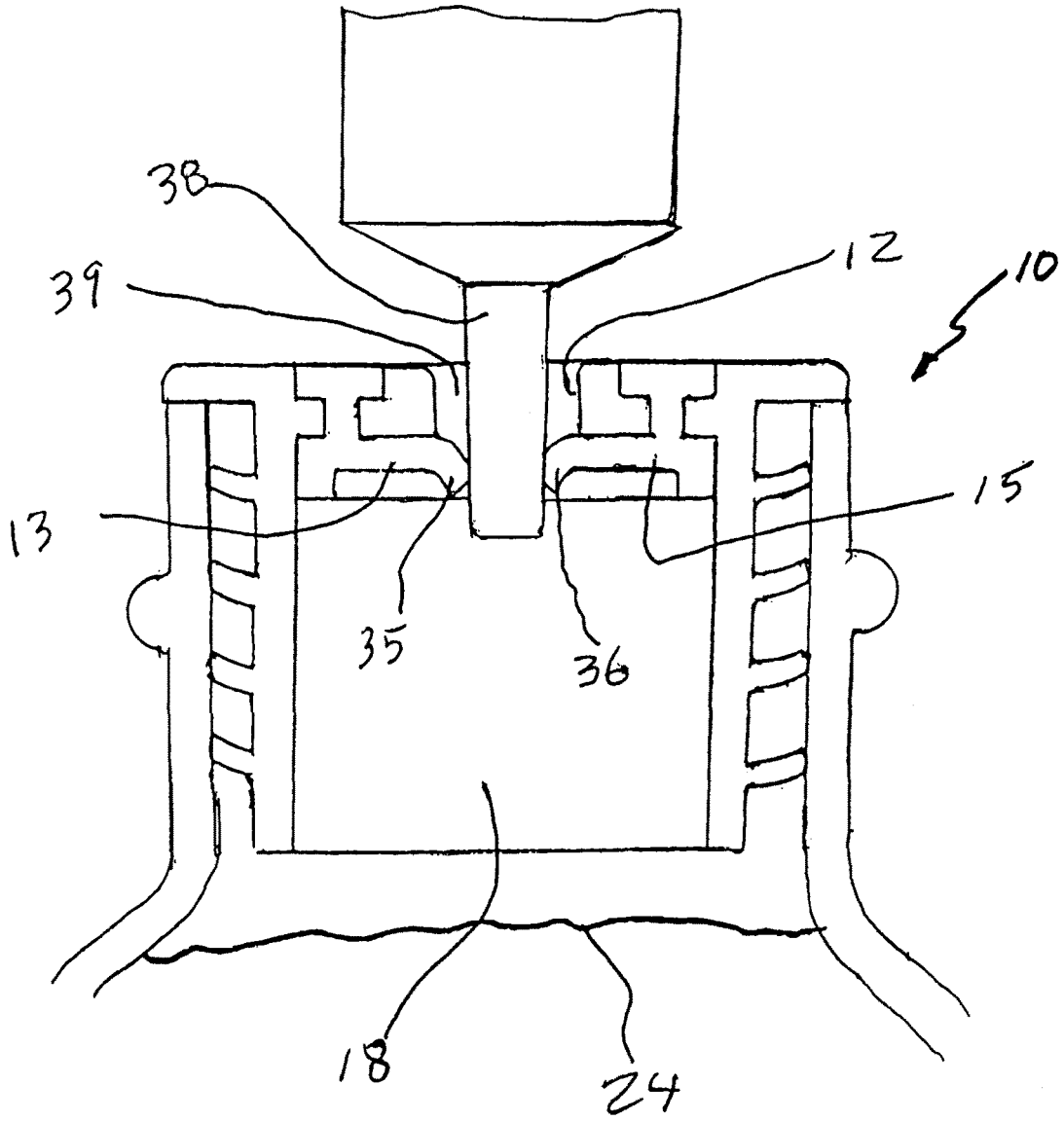
FIG. 6 is a cross-sectional view of the stopper accepting a luer slip tip I.V. syringe.

By comparison, FIG. 6 clearly demonstrates why the I.V. luer slip tip syringe 38 fails to form a liquid tight engagement fit with upper entrance port opening 12.1. Simply stated, the smaller diameter I.V. luer tip dimension of only 0.160 inches does not contact and form a surface-to-surface seal against the larger 0.200 inch diameter port opening 12.1 of the upper entrance port 12 creating a substantial fluid flow spillage and leakage gap 39 even though the I.V. luer syringe tip 38 can purse the open valve 13 and the leafs 35 and 36.

Figure 7:
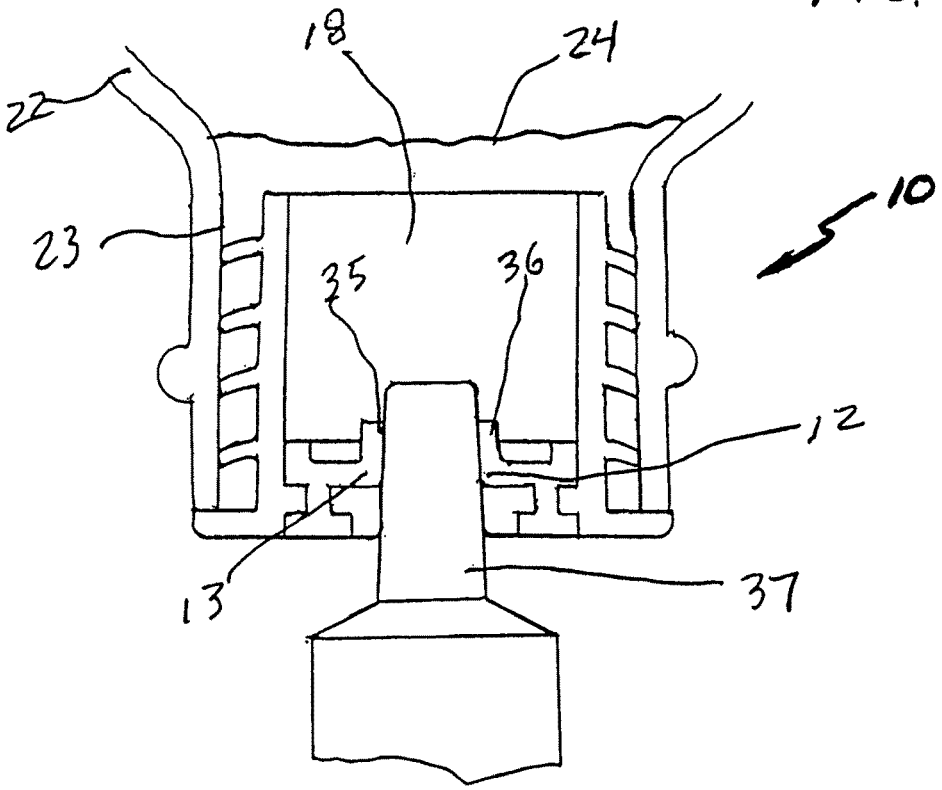
FIG. 7 is a cross-sectional view of the stopper accepting an oral enteric tip syringe when the bottle is in its inverted position depicting the syringe tip with a leakproof liquid seal.
Figure 8:
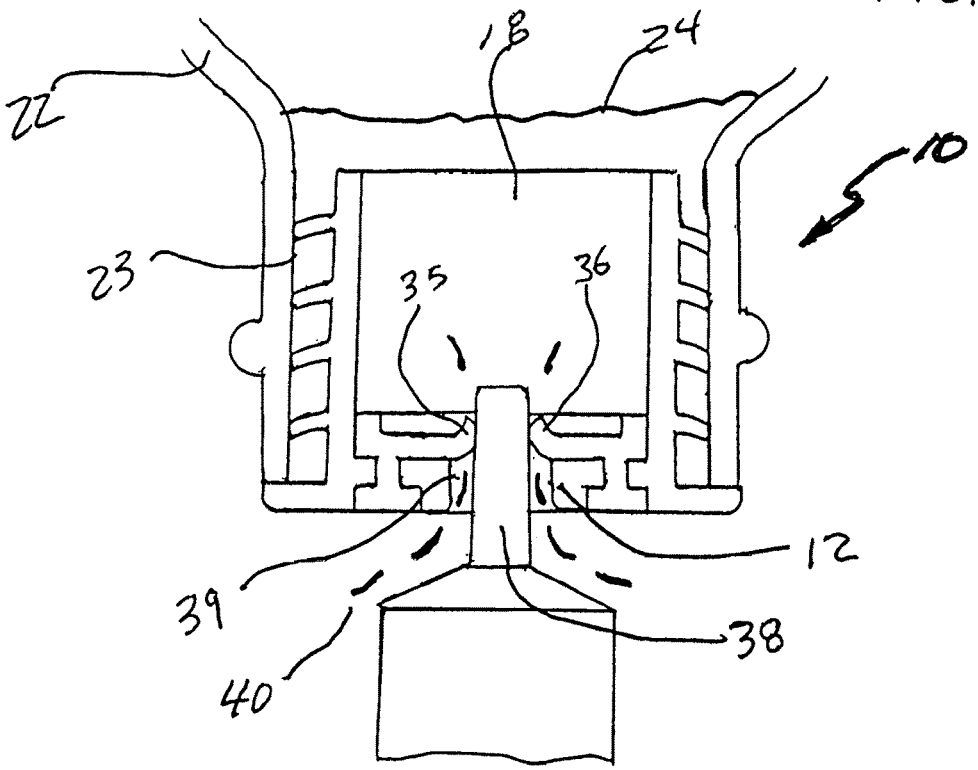
FIG. 8 is a cross-sectional view of the stopper accepting an I.V. luer slip tip syringe when the bottle is in its inverted position depicting the liquid bypassing the split septum valve and leaking fluid medication out the outer entrance port opening.

The liquid tight sealing of the oral/enteric syringe tip 37 when the stopper 10 is used in an inverted bottle container 22 is further illustrated in FIG. 7, and the spillage and leakage 40 from using an I.V. luer slip tip syringe is illustrated in the FIG. 8 comparison.

The use of the precise milliliter graduated oral/enteric syringe tip 37 with stopper 10 is very important in assuring the aspiration, collection, and administration of the exact prescribed dosage for an infant or child compared to pouring medication into an inaccurate teaspoon or medicine cup which often results in overmedicating.

During use, the oral/enteric syringe 37 is inserted into the upper entrance port 12 on an upright bottle container 22 that includes stopper 10. The syringe tip 37 forms a wedge lock leakproof seal with the upper entrance port opening 12.1 while simultaneously opening the valve 13. Next, the bottle container 22 is inverted as illustrated in FIG. 7, and the syringe tip 37 is used to aspirate and withdraw the exact prescribed dosage of liquid medication contents 24, usually one to five milliliters. The bottle container 22 is returned to its original upright position, and the syringe tip 37 removed from upper entrance port 12 which in turn automatically closes the valve 13 to atmosphere and the syringe tip 37 utilized to orally dispense the withdrawn liquid medication contents 24 into the patient's mouth whether adult, infant or child.

The normally biased closed valve 13 continues to preserve and protect the liquid medication contents 24 within the bottle container 22 from being open to atmosphere to prevent degradation and contamination of the contents 24. As such, the unique closed system design of stopper 10 as shown and discussed in detail increases child and infant safety, helps to avoid accidental overdose, helps to prevent contamination and spills, improves accurate dosing, and allows for use with original child safety screw cap 31 as shown in FIG. 4.

Figure 9:
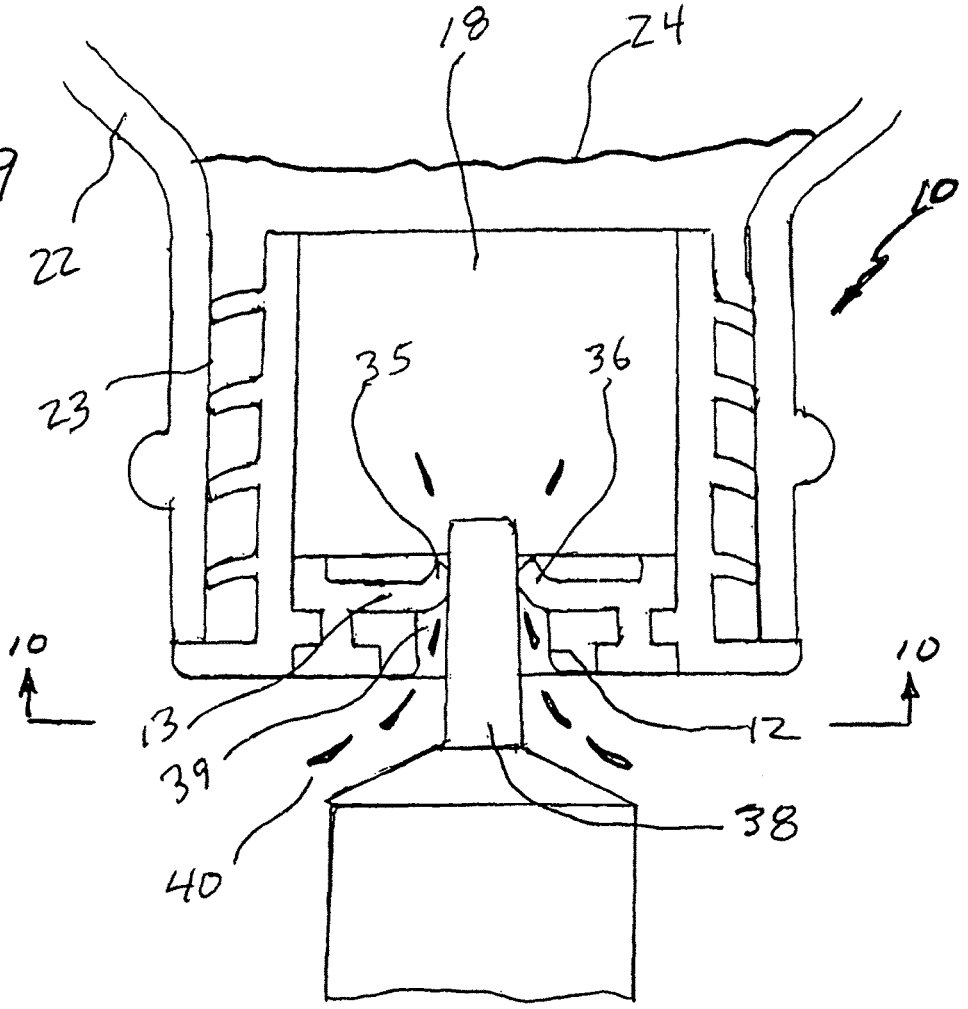
FIG. 9 is an enlarged view of the stopper depicted in FIG. 8 showing the liquid bypassing the valve and leaking out the entrance port opening when inserting a luer slip tip syringe.
Figure 10:
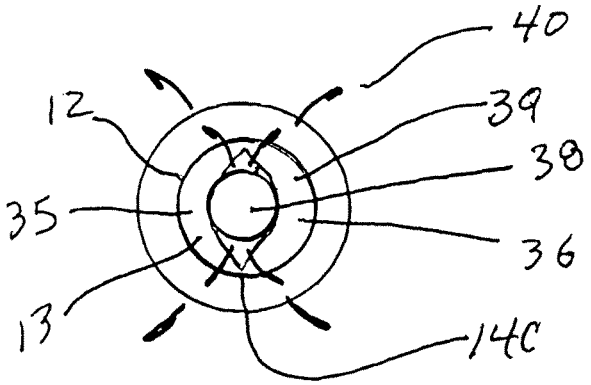
FIG. 10 is a partial bottom cross-sectional view of the liquid leakage out the split septum valve and entrance port opening taken along Lines 10-10 from FIG. 9.

FIG. 9 is an enlarged view of the stopper 10 depicted in FIG. 7 showing the bottled liquid 40 bypassing the valve 13 and leaking out the entrance port 12 when inadvertently or improperly using an I.V. luer syringe tip 38. While the use of the oral/enteric syringe tip 37 forms a wedge lock liquid tight engagement seal with the upper entrance port opening 12.1 as illustrated and discussed in FIGS. 5 and 7, such liquid tight engagement seal simply is not the case when using an I.V. luer slip tip syringe as shown in FIG. 9. The improper use of an I.V. luer syringe is readily indicated to the user due to spillage and leakage 40 that stopper 10 is to be used only with a an appropriate oral/enteric syringe tip 37 and not with an I.V. luer slip tip syringe 38. FIG. 10 is a cross-sectional view depicting the I.V. luer slip tip 38 spillage and leakage 40 taken along Lines 10-10 from FIG. 9. As previously pointed out, the valve slit 14 is 0.180 inches wide, which is wider than the 0.160 inch diameter dimension used on the I.V. luer slip syringe 38. Although there is some sealing contact between the outside surfaces of an I.V. luer syringe 38 and the lips or leaves 35, 36, the 0.180-inch slit is wider than the I.V. luer tip diameter, and thus there is no sealing contact at the slit ends 14C such that leakage 40 takes place through both the slit 14 on the valve 13 and through the gap 39 on the upper entrance port 12.

Figure 11:
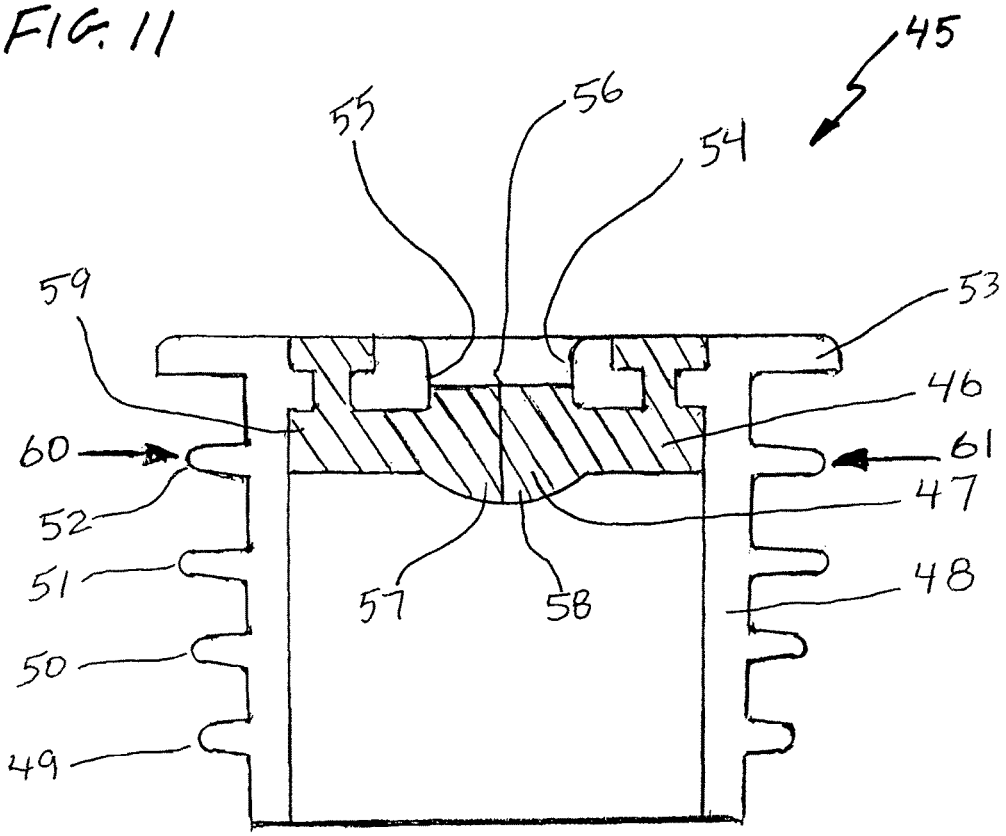
FIG. 11 is a cross-sectional view of an intended commercial embodiment of the stopper.

FIG. 11 is a cross-sectional view of an intended commercial embodiment of a stopper 45 comprising all the features, benefits, and performance characteristics of the stopper 10 previously shown and described in FIGS. 1-10 along with enhanced performance features to both the diaphragm septum portion 46, the valve 47 and the outer housing 48. The septum portion 46 and the valve 47 are shown cross hatched in the drawings. The stopper 45 illustrates the configuration typically used in a 24 mm bottle having a nominally dimensioned neck opening of about 0.720 inches (18.3 mm) but the dimensions can be scaled downwardly or upwardly for 20 mm or 28 mm external bottle neck openings. The housing 48 is molded from semi-rigid low-density polyethylene and includes four circular rows of fins 49, 50, 51, and 52 having distinct performance characteristics.

The first fin 49 is dimensionally undersized to 0.710 inches (18 mm) such that the fin 49 acts as an ease-of-insertion or leader means to pilot the entire stopper 45 into the larger 0.720-inch (18.3 mm) neck opening of the 24 mm bottle.

The second fin 50 is dimensioned at 0.720 inches (18.3 mm) to form a kiss match dimension with the bottle opening of 0.720 inches (18.3 mm) to further enhance the concentric insertion of stopper 45 into the bottle's neck opening to prevent cocking or misalignment of the stopper 45 into the bottle opening during manual insertion.

The third fin 51 and fourth fin 52 are oversized in dimension to about 0.800 inches (20.3 mm) to form a flexible interference liquid tight internal press fit exactly like press fit fin 34 as shown and described in FIG. 4.

All four fins 49, 50, 51, and 52 are circular and thinly molded, that is, about 0.030 inches (0.75 mm) thick to form a semi-rigid flexible manually-insertable press fit to securely seat the stopper 45 using the top flange 53 as shown and described in FIG. 4.

The housing 48 forms the first shot or stage of the two-shot or stage co-joined injection molded process while the diaphragm septum portion 46 forms the second shot or stage of the molding process as previously shown and described in FIGS. 1-4. The septum portion 46 is molded in the second shot or phase of the two-stage process from 40 to 50 Shore A durometer flexible synthetic rubber injection molded thermoplastic elastomer from Poly One GLS Corp. The valve 47 is integrally molded in as part of the diaphragm septum portion 46. The valve 47 is co-joined molded within the housing 48 such that it is compressively molded within the rigid entrance port 54 wherein the inner walls 55 that form the opening of entrance port 54 inwardly compressively bias valve slit 56 to a normally biased sealed closed position. In the intended commercial embodiment, the valve 47 is configured with left and right split septum leafs 57 and 58 having a dimensional length greater than width to extend the sealing surface area of the slit 56 to at least 0.125 inches (3.2 mm).

Accordingly, the diaphragm thickness 59 of the diaphragm portion 46 has been increased to a full 0.080 inches (2 mm) wherein the fourth fin 52 functions to inwardly compress the diaphragm 46 in the area thereof laterally adjacent to fin 52 once the stopper 45 is press fit into the bottle's neck opening. This inward compressive force acting upon the diaphragm portion 46 that in turn acts upon the valve slit 56 keeps the valve 47 in a normally biased sealed closed position even after repeated insertions of an enteral syringe as previously shown and described in FIGS. 6-10. This inward compressive force applied by the fourth fin 52 to bias the valve slit 56 closed is depicted as inward forces shown by arrows 60 and 61.

It is important to note that stopper 10 of the instant invention as shown and described in FIGS. 1-10 along with the intended commercial embodiment shown and described in FIG. 11 presents a substantial advancement in providing a safety sealed stopper which prevents the misuse and misapplication between oral/enteric syringes and I.V. luer slip tip syringes. In addition, the stopper can only be properly used with an oral/enteric tip syringe to withdraw the correct prescribed liquid medication into the syringe and then administer the aspirated syringe contents orally into a patient's mouth.

As such, the normally closed system design of these stoppers prevents the oral mouth ingestion of the bottle's contents directly from the bottle that is especially important as a safety sealed stopper in preventing overdosing or poisoning in infants and children.

Many variations in materials and design details can be utilized without departing from the unique features and benefits of the safety sealed bottle stopper invention.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A safety sealed bottle stopper for use with a liquid filled bottle container having a cylindrical neck opening, said stopper comprising:

a rigid exterior housing forming a liquid tight engagement with said cylindrical neck opening;

said housing having an upper entrance port;

a lower communication path; and a resilient split septum valve having a valve slit which defines two valve edge surfaces that are in face-to-face sealing contact with each other, said valve positioned between said lower communication path and said upper entrance port, said valve slit biased to a compressive back pressure resistant normally closed sealed position by said stopper exterior housing including means in conjunction with said cylindrical neck opening for applying an inward compressive force to said valve edge surfaces so as to bias said valve slit to a closed position wherein said valve prevents spillage or leakage from said bottle when said liquid filled bottle is inverted and/or squeezed.

2. The stopper of claim 1, wherein said valve comprises a resilient synthetic rubber material.

3. The stopper of claim 1 wherein said stopper is utilized in conjunction with an oral enteric syringe having a conically tapered tip dimensioned greater in diameter than an I.V. luer conically tapered tip.

* * * * *